United States Patent [19]

Troncoso

[11] Patent Number: 4,685,379

[45] Date of Patent: Aug. 11, 1987

[54] MULTIPLE FIRING GUN AND TRIGGER EXTENSION ASSEMBLY

[76] Inventor: Vincent F. Troncoso, 14090-6100 Rd., Montrose, Colo. 81401

[21] Appl. No.: 885,413

[22] Filed: Jul. 14, 1986

[51] Int. Cl.[4] ..... F41C 19/00

[52] U.S. Cl. ..... 89/136; 42/69.01; 89/129.02

[58] Field of Search ..... 42/69.01, 69.02, 69.03; 89/136, 129.02

[56] References Cited

U.S. PATENT DOCUMENTS

| | | | |
|---|---|---|---|
| 955,015 | 4/1910 | Taylor | 42/69.01 X |
| 1,837,093 | 12/1931 | Andrews | 42/69.01 |
| 2,509,540 | 5/1950 | Sunderland | 42/69.01 X |
| 2,589,227 | 3/1952 | Colley | 42/69.01 |
| 2,607,148 | 8/1952 | Simpson | 42/69.01 |
| 3,091,878 | 6/1963 | Savioli | 42/69.01 |
| 4,276,808 | 7/1981 | York | 89/136 |
| 4,514,923 | 5/1985 | Teel | 42/69.01 |
| 4,532,852 | 8/1985 | Hance et al. | 89/136 |
| 4,619,183 | 10/1986 | Benelli | 89/129.02 |

*Primary Examiner*—David H. Brown
*Attorney, Agent, or Firm*—Donald E. Nist

[57] ABSTRACT

The gun is semi-automatic and preferably is an M-16/AR-15. It includes a firing trigger, frame and trigger guard, as well as a multiple firing gun trigger extension assembly. The assembly includes an elongated trigger guard bar incorporated into the trigger guard below the gun trigger, and a trigger-actuating component rotatably secured to the guard bar and including a supplemental trigger below the guard bar and a number of spaced trigger-actuating fingers disposed in an arc above the supplemental trigger. The fingers during their rotation can contact the gun trigger directly to affect sequential firing of the gun or can sequentially strike an interposed trip lever which is rotatably secured to the guard bar, the trip lever thereupon sequentially striking the gun trigger to effect the firing. Suitable springs and the like can return the trip lever and other parts to the resting position. A second supplemental trigger can be connected above the fingers to effect a second series of sequential firing.

7 Claims, 6 Drawing Figures

MULTIPLE FIRING GUN AND TRIGGER EXTENSION ASSEMBLY

BACKGROUND OF THE INVENTION

1. Field of the Invention

The present invention generally relates to weapons and more particularly to an improved multiple-firing gun and the assembly thereof which effects the multiple firing.

2. Prior Art

Various semi-automatic weapons such as rifles, automatic pistols and the like are currently available. With these weapons the triggers must be sequentially pulled in order to cause sequential firing. The speed of firing is limited by the gunner's ability to squeeze the trigger, fire, release the trigger and repeat the sequence. Such firing is not very rapid. Such weapons can be rendered fully automatic by modifying their firing mechanism. By full automatic is meant that once the trigger is in the firing position, the gun fires sequentially until the trigger is released. However, such weapons, except for military and certain law enforcement use, are generally illegal.

It would be desirable to provide a simple, efficient, inexpensive and durable device to enable a gunner to sequentially fire a semi-automatic weapon at an increased speed, without modifying the gun to the full automatic mode. For safety's sake and for sporting purposes, the device should limit the number of shots fired in a sequence to a reasonably small number, for example, 2–5 shots, with a pause or separate action being required before the sequence could be re-initiated. Such a device would be very helpful in hunting large, dangerous game such as African big game, grizzly bears and Kodiak bears and the like, where the hunter could be in serious danger from a charging animal if the hunter could not shoot the semi-automatic weapon rapidly and accurately enough.

SUMMARY OF THE INVENTION

The improved semi-automatic gun of the present invention bearing the multiple firing trigger extension assembly of the present invention satisfies all the foregoing needs. The gun and trigger extension assembly are substantially as set forth in the Abstract. Thus, the gun preferably is an M-16/AR-15 rifle and includes a gun trigger, frame with trigger guard and the trigger extension assembly of the invention which is incorporated into the trigger guard. That assembly may be fabricated of steel or the like and includes an elongated trigger guard bar below the gun trigger and rotatably bearing a preferably one-piece trigger-actuating component which includes a supplemental trigger below the guard bar and a plurality of spaced trigger-actuating fingers disposed in an arc thereabove. The fingers during their rotation, as by pulling the supplemential trigger, either directly or indirectly sequentially strike and move the gun trigger to sequentially fire the gun. In the latter case, a trip lever is rotatably interposed between the gun trigger and fingers and is sequentially struck by the fingers so as to itself sequentially strike the trigger. Return springs and the like can be provided to bias the gun trigger, lever and supplemental trigger to the resting position.

In one embodiment a second supplemental trigger is connected to the trigger-actuating component above the fingers and is used to rotate the component in one direction for one set of sequential firing, whereupon the first supplemental trigger is used to rotate the component in the opposite direction for a second set of sequential firing.

Further features of the improved multiple firing gun and trigger extension assembly of the present invention are set forth in the following detailed description and accompanying drawings.

DRAWINGS

DETAILED DESCRIPTION

FIGS. 1, 2 and 4

Figures 1, 2, 3, 4, 5, 6:
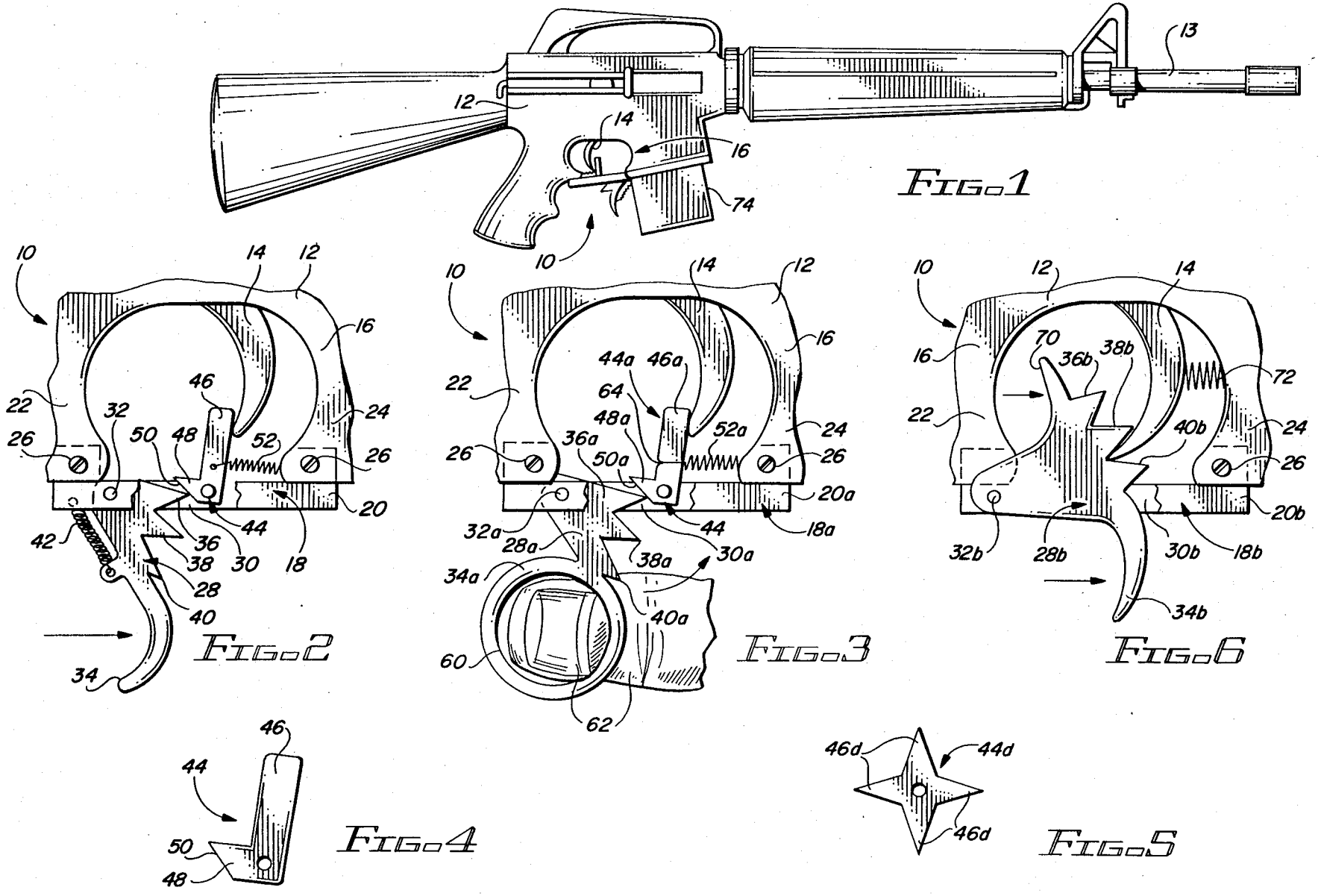
FIG. 1 is a schematic side elevation of a preferred embodiment of the multiple-firing semi-automatic gun of the present invention bearing a first preferred embodiment of the trigger extension assembly of the present invention.
FIG. 2 is an enlarged schematic side elevation, partly broken away, of the novel trigger extension assembly of FIG. 1.
FIG. 3 is an enlarged schematic side elevation, partly broken away, of a second preferred embodiment of the novel trigger extension assembly of the present invention.
FIG. 4 is a schematic side elevation of the trip lever of FIG. 2.
FIG. 5 is a schematic side elevation of a modified form of the trip lever of the invention; and, FIG. 6 is an enlarged schematic side elevation, partly broken away, of a third preferred embodiment of the novel trigger extension assembly of the present invention.

Now referring more particularly to FIGS. 1, 2 and 4 of the drawings, a first preferred embodiment of each of the multiple firing gun and trigger extension assembly of the present invention is depicted therein. Thus, an M-16/AR-15 semi-automatic rifle 10 is shown, which is of standard construction, including a frame 12, barrel 13 and trigger 14. However, the lower part of the trigger guard 16 of gun 10 has been modified to include the novel trigger extension assembly 18 of the present invention.

Assembly 18 includes (FIG. 2) an elongated about horizontal trigger guard bar 20 substituting for the original M-16/AR-15 bottom trigger guard bar (not shown) and secured to depending trigger guard portions 22 and 24 by screws 26 or the like. Bar 20 has a trigger-actuating component 28 rotatably secured thereto. For this purpose, bar 20 may have a vertical slot 30 therein in which component 28 is secured by a cross pin 32. Component 28 preferably is unitary, that is, of one-piece construction and includes a supplemental trigger 34 below bar 20 and three spaced, narrow, triangular pointed fingers 36, 38 and 40 disposed in an arc above trigger 34. Trigger 34 is urged into a forward resting position by spring 42 connected to the front of component 28 and to bar 20 (FIG. 2).

Interposed between trigger 14 and fingers 36, 38 and 40 is a generally L-shaped trip lever 44 (FIG. 4) rotatably secured in slot 30 to bar 20, with the upper arm 46 thereof directly in front of trigger 14 and the lower arm 48 thereof in the path of rotation of fingers 36, 38 and 40. Arm 48 has a downwardly and rearwardly sloped front face 50 against which the point of each finger 36, 38 and 40 sequentially bears to cause arm 46 to sequentially pivot rearwardly and sequentially move trigger 44 rearwardly to sequentially fire gun 10.

Spring 52 allows trigger 14 and arm 46 to return to the resting about to be fired position between sequential urgings into the firing position by fingers 36, 38 and 40. Thus, trigger 34 can be very rapidly pulled in the direction of the arrow in FIG. 2 to very rapidly cause fingers 36, 38 and 40 to sequentially push arm 46 against trigger 14, with forward movements of trigger 14 therebetween, thereby very rapidly firing 3 shots from gun 10. Spring 42 then returns trigger 34 and fingers 36, 38 and 40, lever 44 and trigger 14 automatically to the resting position for refiring. Sets of 3 shots each can rapidly follow upon each other. The single directional movement of trigger 34 to effect each set of 3 shots is considerably faster time-wise to make than having to move trigger 14 by hand back and forth for each shot in order to cause sequential firing of gun 10. Yet each set of shots is limited to 3 for safety purposes. Accordingly, the improved multiple firing gun 10 with assembly 18 therein is of improved construction, performance and safety.

FIG. 3

A second preferred embodiment of the improved multiple-firing trigger extension assembly of the present invention is schematically depicted therein mounted on rifle 10 in place of assembly 18. Thus, assembly 18*a* is shown. Components of assembly 18*a* which are similar to those of assembly 18 bear the same numerals but are succeeded by the letter "a".

Assembly 18*a* is substantially identical to assembly 18 except that assembly 18*a* does not have a return spring, such as 42, for trigger 34*a* . Instead, trigger 34*a* bears a ring 60 in which the gunner inserts his or her finger 62 and by which the gunner can urge trigger 34*a* fully forward into the resting ready-to-fire position. Also, arm 46*a* may have a groove 64 in it to facilitate connection of spring 52*a* thereto. Bar 20*a*, component 28*a*, fingers 36*a*, 38*a* and 40*a* and lever 44*a* are otherwise identical to those components of assembly 18 and have similar properties and advantages.

FIG. 6

A third preferred embodiment of the multiple firing trigger extension assembly of the present invention is schematically depicted in FIG. 6. Thus, assembly 18*b* is shown therein connected to gun 10 in place of assemblies 18 and 18*a*. Components thereof similar to those of assembly 18 or 18*a* bear the same numerals but are succeeded by the letter "b".

Assembly 18*b* is substantially identical to assembly 18 except that no return spring for supplemental trigger 34*b* is provided. Moreover, a second supplemental trigger 70 is integrally connected to component 28*b* above fingers 36*b*, 38*b* and 40*b*. In addition, fingers 36*b*, 38*b* and 40*b* are of more or less stepped configuration instead of being narrow, triangular and pointed. No trip lever such as 44 is provided. Instead fingers 36*b*, 38*b* and 40*b* directly sequentially strike and move trigger 14 to sequentially fire gun 10. A return spring 72 may be provided behind trigger 14 in guard 16 to rapidly urge it into the proper forward position between firings.

It will be noted that when trigger 34*b* is pulled rearwardly in the direction of the arrow, a set of 3 shots is fired by rotation of fingers 36*b*, 38*b*, 38*b* and 40*b* counterclockwise to effect sequential activation of trigger 14. When trigger 34*b* reaches the rear end of the path of travel, trigger 70 can then be pulled rearwardly to cause another set of 3 shots to be sequentially fired, fingers 36*b*, 38*b* and 40*b* rotating clockwise to effect such firing. Triggers 70 and 34*b* can be simultaneously contacted by the forefinger and middle finger, respectively, and worked back and forth, so that the described repetition of sets of 3 shots can be continued very rapidly until gun 10's magazine 74 (FIG. 1) is exhausted. Thus, very rapid controlled shooting can be carried out. Assembly 18*b* also has the other advantages of assemblies 18 and 18*a*.

FIG. 5

FIG. 5 schematically illustrates a modified form of the trip lever such as is utilized in the embodiments of FIGS. 2 and 3. Thus, trip lever 44*d* is shown. Instead of being L-shaped, as are levers 44 and 44*a*, lever 44*d* is in the form of a 4-pointed star rotatably supported through its center at a suitable location on or above bar 20 (not shown). Fingers 36, 38 and 40 or their equivalents can rotate lever 44*d* by contact with its arms 46*d*, which arms 46*d* in turn can effect the desired movement of trigger 14.

By the term M-16/AR-15 is meant the M-16 rifle and the civilian version thereof which is known as the AR-15 rifle.

Various modifications, changes, alterations and additions can be made in the improved multiple-firing gun and trigger extension assembly of the present invention, their components and parameters. All such modifications, changes, alterations and additions as are within the scope of the appended claims form part of the present invention.

What is claimed is:

1. An improved multiple firing gun assembly, said gun assembly comprising, in combination:

A. A semi-automatic gun having a firing trigger and a frame including a trigger guard; and, B. a multiple firing gun trigger extension assembly, including i. an elongated horizontal trigger guard bar incorporated into the lower portion of said trigger guard ii. a gun trigger-actuating component rotatably secured to said trigger guard bar and including a. a supplemental trigger below said guard, movable between a resting position and a sequential firing position, b. a plurality of spaced trigger-activating fingers disposed in an arc above said supplemental trigger, and c. means including a trip lever rotatably secured to said trigger guard bar and extending thereabove for movement between a resting position and a trigger actuating position, said trip lever being in the path of travel of said fingers and rotatable thereby to effect sequential multiple firing movement of said gun trigger.

2. The assembly of claim 1 wherein said trigger-actuating component includes a second supplemental trigger above said guard bar and said fingers in said trigger guard to effect rotation of said trigger-actuating component in a first direction while said first supplemental trigger effects rotation of said trigger-actuating component in the opposite direction, whereby a first sequence of multiple firing is effected by said first supplemental trigger and a second such sequence is effected by said second supplemental trigger.

3. The improved gun of claim 1 wherein said trip lever is star-shaped, the arms thereof being rotatable by said fingers to effect sequential multiple firing movement of said gun trigger.

4. The improved gun of claim 1 wherein said trip lever is generally L-shaped with a sloped finger-contacting surface, and wherein said assembly includes a trip lever return spring connected to said trip lever and to said gun frame to automatically return said lever to said resting position.

5. The improved gun of claim 4 wherein said trigger-actuating component includes means for returning said supplemental trigger to said resting position.

6. The improved gun of claim 5 wherein said supplemental trigger return means comprises a spring connected to said supplemental trigger and said guard bar.

7. The assembly of claim 5 wherein said supplemental trigger return means comprises a trigger finger ring forming part of said supplemental trigger.

* * * * *